US005690475A

United States Patent [19]

Yamada et al.

[11] Patent Number: 5,690,475

[45] Date of Patent: Nov. 25, 1997

[54] SCROLL COMPRESSOR WITH OVERLOAD PROTECTION

[75] Inventors: Sadayuki Yamada, Otsu; Nobuyuki Shiratake, Kusatsu; Hiroyuki Fukuhara, Otsu; Shigeru Muramatsu, Kusatsu, all of Japan

[73] Assignee: Matsushita Electric Industrial Co., Ltd., Osaka-fu, Japan

[21] Appl. No.: 707,356

[22] Filed: Sep. 4, 1996

Related U.S. Application Data

[63] Continuation of Ser. No. 364,631, Dec. 27, 1994.

[30] Foreign Application Priority Data

Dec. 28, 1993 [JP] Japan ..... 5-336364

[51] Int. Cl.[6] ..... F04B 49/10

[52] U.S. Cl. ..... 417/32; 417/292; 417/310; 62/126; 236/93 R

[58] Field of Search ..... 417/32, 292, 310; 62/126; 236/93 R; 418/55.1

[56] References Cited

U.S. PATENT DOCUMENTS

| | | | |
|---|---|---|---|
| 4,383,805 | 5/1983 | Teegarden et al. | 417/308 |
| 4,456,435 | 6/1984 | Hiraga et al. | 417/302 |
| 4,505,651 | 3/1985 | Terauchi et al. | 417/440 |
| 4,514,150 | 4/1985 | Hiraga et al. | 417/440 |
| 4,560,330 | 12/1985 | Murayama et al. | 418/55.1 |
| 4,596,520 | 6/1986 | Arata et al. | 418/55.1 |
| 4,596,521 | 6/1986 | Maurayama et al. | 418/55.1 |
| 4,714,415 | 12/1987 | Mizuno et al. | 418/55.1 |
| 4,820,130 | 4/1989 | Eber et al. | 417/32 |
| 4,840,545 | 6/1989 | Moilanen | 417/301 |
| 4,846,633 | 7/1989 | Suzuki et al. | 417/310 |
| 4,998,864 | 3/1991 | Muir | 417/410.5 |
| 5,118,260 | 6/1992 | Fraser, Jr. | 417/32 |
| 5,141,407 | 8/1992 | Ramsey et al. | 417/292 |
| 5,167,491 | 12/1992 | Keller, Jr. et al. | 417/32 |
| 5,169,294 | 12/1992 | Barito | 417/310 |

FOREIGN PATENT DOCUMENTS 63-268993 4/1988 Japan .

*Primary Examiner*—Timothy Thorpe
*Assistant Examiner*—Xuan M. Thai
*Attorney, Agent, or Firm*—Panitch Schwarze Jacobs & Nadel, P.C.

[57] ABSTRACT

In a scroll compressor, an internal space of a sealed container is partitioned by a cylinder-shaped partition wall into a delivery chamber and a suction chamber including a driving motor, and a pressure relief valve is provided with the cylinder-shaped partition wall, and a thermal switch is disposed at the position to receive heat of the high-pressure coolant relieved from the pressure relief valve into the suction chamber, thereby, the pressure relief valve reduces pressure of coolant of the delivery chamber, and thermal switch is operated by the coolant from the pressure relief valve so as to stop the driving motor.

5 Claims, 6 Drawing Sheets

SCROLL COMPRESSOR WITH OVERLOAD PROTECTION

This application is a continuation of 08/364,631 filed Dec. 27, 1994.

FIELD OF THE INVENTION AND RELATED ART STATEMENT

1. Field of the Invention

This invention relates to a scroll compressor to be used in an air-conditioner or the like for a business use and a household use.

2. Description of the Prior Art

A general scroll compressor has a stationary scroll member and an orbiting scroll member which are formed to have involute-curved shapes. These scroll members are inwardly engaged with each other with their wraps facing together. The orbiting scroll member is driven by a crank shaft to make orbiting motion. Volume of a compressed gas space defined by two scroll members decreases in response to movement of the space toward the center of the scroll members which is caused by the orbiting motion.

FIG. 6 is a cross-sectional view showing a conventional scroll compressor 100 disclosed in the Japanese unexamined and published patent application (TOKKAI) SH0 63-268993. FIG. 7 is a cross-sectional view, which is drawn by the inventor taken on line VII—VII of FIG. 6, showing a partition wall 110 of the scroll compressor 100 of FIG. 6.

In FIG. 6, a sealed container 102 of a scroll compressor 100 includes a compressor part 3, which is used for compressing coolant such as a flon gas, and a driving motor 4 for actuating the compression part 3.

An internal space of the sealed container 102 is partitioned by a cylinder-shaped partition wall 110 into a delivery chamber 7, which is located in an upper part of the sealed container 102, and a suction chamber 8 which is located in a lower part of the sealed container 102.

As shown in FIG. 6, the compression part 3 comprises a stationary scroll member 3*a* and an orbiting scroll member 3*b* which is engaged with the stationary scroll member 3*a*. A compression chamber 9 is provided between the stationary scroll member 3*a* and the orbiting scroll member 3*b*.

The driving motor 4 is disposed in the suction chamber 8, and configured by an electric motor 5, such as a single-phase induction motor 5, held by a bearing system 6. The bearing system 6 comprises a bearing member 6', an oldham ring 13 and an eccentric bearing 21. In the electric motor 5, a rotor 5*a* is fixed on a crank shaft 5*b*, and a stator 5*c* is fixed to the sealed container 102 by shrinkage fit. The crank shaft 5*b* is rotatably held by the bearing system 6, and engaged with the orbiting scroll member 3*b* via the oldham ring 13 and the eccentric bearing 21 so that the orbiting scroll member 3*b* can make an orbiting motion. Stator winding 5*d* is connected to a terminal 12 by lead wires (not shown), and supplied the electric power via the terminal 12. The oldham ring 13 is provided between the orbiting scroll member 3*b* and the bearing system 6 in order to prevent rotation of the orbiting scroll member 3*b* during the operation of the scroll compressor 100.

As shown in FIG. 6 and FIG. 7, the cylinder-shaped partition wall 110 is fixed on an inner surface of the sealed container 102 by welding or shrinkage fit. Furthermore, the stationary scroll member 3*a* and the bearing system 6 are integrally fixed at some positions of the cylinder-shaped partition wall 110 by the respective plural (e.g., 7 pieces) securing pins 110*a*.

The operation of the conventional scroll compressor 100 will be elucidated with reference to arrows A, B, C and D shown in FIG. 6. Arrows A, B, C and D designate a flow of the coolant.

As shown by the arrow A, a low-pressure coolant is supplied to the suction chamber 8 from a known evaporator (not shown) via a suction pipe 14. In the suction chamber 8, the low-pressure coolant exerts pressure on a surface of lubricant oil 11 stored in a bottom part of the sealed container 102, and additionally cools the driving motor 4 of the scroll compressor 100.

As shown by the arrow B, the low-pressure coolant is supplied to the compression chamber 9 via a suction hole 6*a* bored in the bearing system 6. In the compression chamber 9, the low-pressure coolant is compressed by the orbiting motion of the orbiting scroll member 3*b* against the stationary scroll member 3*a*, and compressed into a high-pressure coolant.

As shown by the arrow C, the high-pressure coolant is supplied to the delivery chamber 7 via a discharging hole 3*c* formed in the stationary scroll member 3*a*. The high-pressure coolant is temporarily stored in the delivery chamber 7 in order to prevent pulsating delivery of the high-pressure coolant from the delivery chamber 7 in the below-mentioned state shown by the arrow D.

As shown by the arrow D, the high-pressure coolant is supplied to a known condenser (not shown) via a discharging pipe 15. And, as is well known, a refrigerating cycle of the coolant is completed by connecting a known expansion device (not shown) between the condenser and the evaporator.

In the aforementioned prior art, there has been no measure against a sudden and abnormal increase of pressure of the high-pressure coolant in the delivery chamber 7 caused by the above-mentioned other devices of the refrigerating cycle. Such sudden and abnormal increase of pressure is, for instance, caused by a stoppage of a blower for cooling the high-pressure coolant at the condenser. At such case, pressure of the high-pressure coolant in the condenser increases rapidly, and the sudden and abnormal increase of pressure in the condenser influences the pressure in the delivery chamber 7 via the discharging pipe 15, so that the sudden and abnormal increase of pressure occurs in the high-pressure coolant in the delivery chamber 7. Therefore, there could be problems that the electric motor 5 makes a reversal rotation, and the compression part 3 and the driving motor 4 are damaged because of the reversal rotation of the electric motor 5.

A concrete operation of the electric motor 5 until the state of the above-mentioned reversal rotation will be elucidated with reference to FIG. 5. FIG. 5 shows a characteristic curve showing a torque curve 50 of an electric motor 5, wherein the abscissa is graduated with number of revolutions, and the ordinate is graduated with a torque.

As has been stated in the above, for example, when the blower is out of operation by its mechanical failure, pressure of the high-pressure coolant makes sudden and abnormal increase in the delivery chamber 7. Thereby, in the electric motor 5, a load torque becomes larger than a stalling torque shown by a point S of FIG. 5. Therefore, number of revolutions of the electric motor 5 begins to decrease from a point $S_N$ of FIG. 5 along the torque curve 50. When the torque of the electric motor 5 further reaches a point R of FIG. 5 caused by the influence of pressure of the high-pressure coolant in the delivery chamber 7, the electric motor 5 goes out of operation. And, the scroll compressor 100 also stops.

Then, the high-pressure coolant stored in the compression chamber 9 begins to flow out of the compression chamber 9 into the suction chamber 8 and drives the orbiting scroll member 3b in an inverse orbiting motion to that of the aforementioned ordinary orbiting motion. As a result, the electric motor 5 is further actuated to make the reversal rotation. When the torque of the electric motor 5 is of a value under zero shown by a point P of FIG. 5, the electric motor 5 generates a reversal torque, and is kept driven in the reversal direction. As a result, the compression part 3 and the driving motor 4 are damaged.

OBJECT AND SUMMARY OF THE INVENTION

The object of the present invention is to provide a scroll compressor that can solve the aforementioned problems.

In order to achieve the above-mentioned object, a scroll compressor in accordance with the present invention comprises:

a sealed container, a cylinder-shaped partition wall provided in the sealed container so as to partition an internal space of the sealed container into a delivery chamber for containing compressed coolant and a suction chamber for containing a driving means, pressure relief means provided on the cylinder-shaped partition wall for relieving the compressed coolant of the delivery chamber when pressure of the compressed coolant exceeds a predetermined pressure, and thermal switch means disposed at the position to receive heat of the compressed coolant relieved from the pressure relief means into the suction chamber for controlling the driving means.

In the above-mentioned scroll compressor, if a sudden and abnormal increase occurs in pressure of the high-pressure coolant of the delivery chamber caused by a stoppage of a blower of the condenser or the like, the pressure relief means is operated by the pressure of the compressed high-pressure coolant of the delivery chamber. Thereby, it is possible to prevent further increase of the pressure of the high-pressure coolant of the delivery chamber. At the same time, the high-pressure coolant flown from the pressure relief means heats the thermal switch means. As a result, the thermal switch means is immediately operated by the rise of the temperature caused by the high-pressure coolant passing from the pressure relief means. As a result, the driving motor stops without an reversal rotation, and it is possible to prevent occurrences of damages in the compression part and the driving motor.

DESCRIPTION OF THE PREFERRED EMBODIMENT

Hereafter, a preferred embodiment of the present invention is described with reference to the accompanying drawings.

[Embodiment 1]

Figure 1:
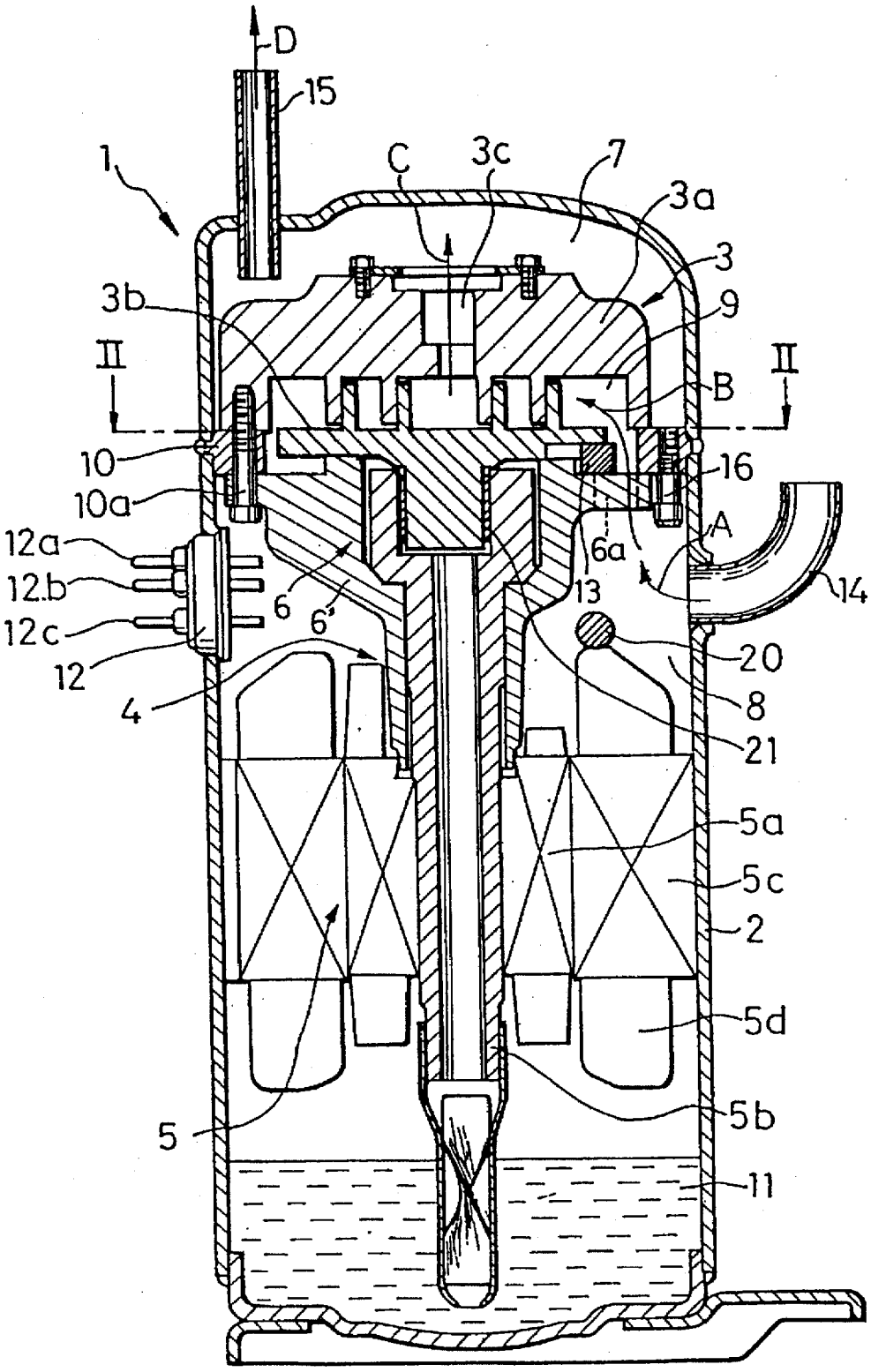
FIG. 1 is a cross-sectional view showing a scroll compressor 1 embodying the present invention.
Figure 2:
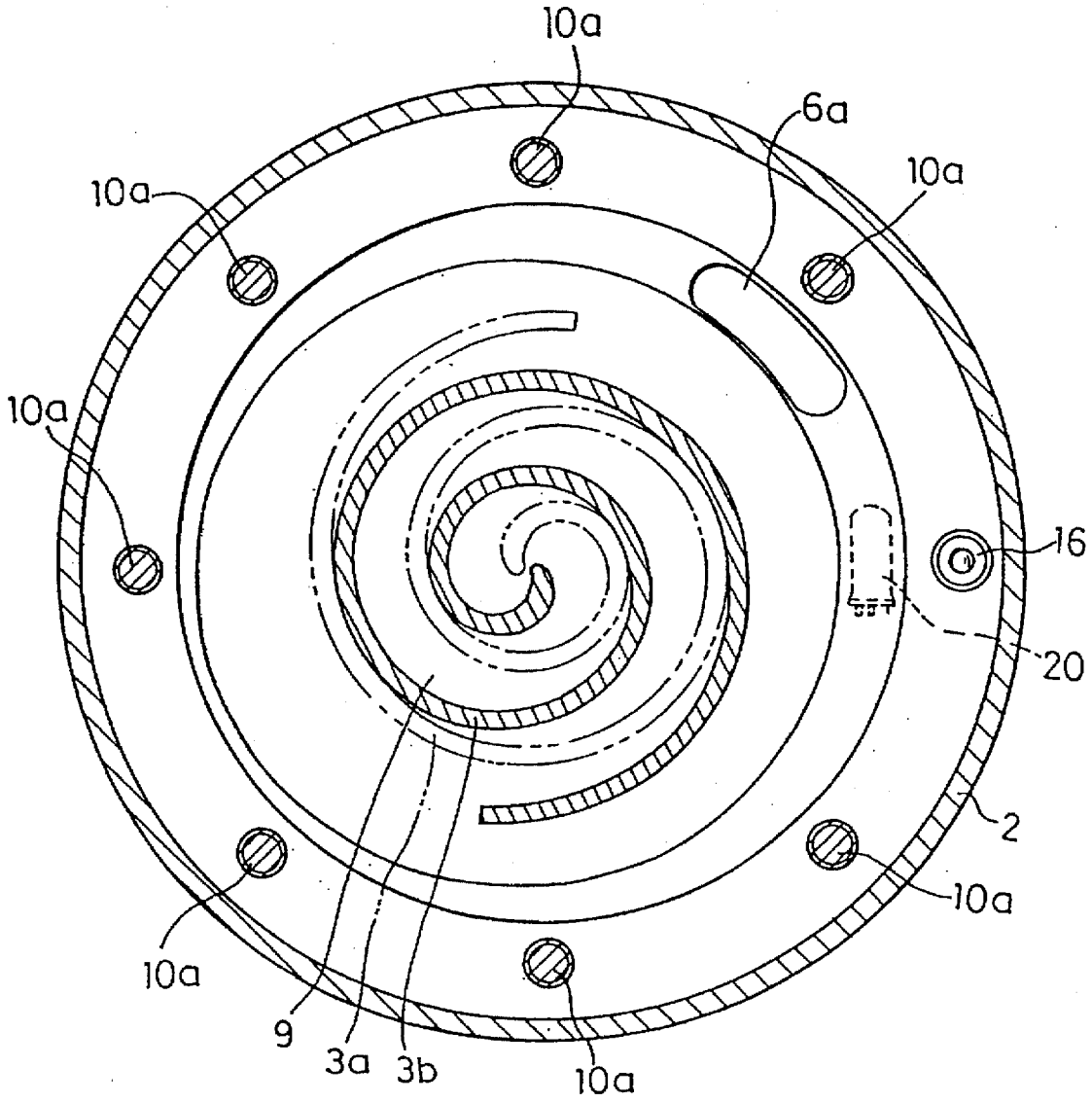
FIG. 2 is a cross-sectional view, which is taken on line II—II of FIG. 1, showing a cylinder-shaped partition wall 10 of the scroll compressor 1 of FIG. 1.

FIG. 1 is a cross-sectional view showing a scroll compressor embodying the present invention. FIG. 2 is a cross-sectional view, which is taken on line II—II of FIG. 1, showing a cylinder-shaped partition wall of the scroll compressor of FIG. 1.

In FIG. 1, a sealed container 2 of a scroll compressor 1 includes a compressor part 3, which is used for compressing coolant such as a flon gas, and a driving motor 4 for actuating the compression part 3.

An internal space of the sealed container 2 is partitioned by a cylinder-shaped partition wall 10 into a delivery chamber 7, which is located in an upper part of the sealed container 2, and a suction chamber 8 which is located in a lower part of the sealed container 2.

As shown in FIG. 1, the compression part 3 comprises a stationary scroll member 3a and an orbiting scroll member 3b which is engaged with the stationary scroll member 3a. A compression chamber 9 is provided between the stationary scroll member 8a and the orbiting scroll member 3b.

The driving motor 4 is disposed in the suction chamber 8, and configured by an electric motor 5, such as a single-phase induction motor 5, held by a bearing system 6. The bearing system 6 comprises a bearing member 6', an oldham ring 13 and an eccentric bearing 21. In the electric motor 5, a rotor 5a is fixed on a crank shaft 5b, and a stator 5c is fixed to the sealed container 2 by shrinkage fit. The crank shaft 5b is rotatably held by the bearing system 6, and engaged with the orbiting scroll member 3b via the oldham ring 13 and the eccentric bearing 21 so that the orbiting scroll member 3b can make an orbiting motion. Stator winding 5d is connected to a terminal 12 by lead wires (not shown) via the below-mentioned thermal switch 20, and supplied the electric power via the terminal 12. The oldham ring 13 is provided between the orbiting scroll member 3b and the bearing system 6 in order to prevent rotation of the orbiting scroll member 3b during the operation of the scroll compressor 1.

As shown in FIG. 1 and FIG. 2, the cylinder-shaped partition wall 10 is fixed on an inner surface of the sealed container 2 by welding or shrinkage fit. Furthermore, the stationary scroll member 3a and the bearing system 6 are integrally fixed on the cylinder-shaped partition wall 10 by plural (e.g., 7 pieces) securing pins 10a.

As an important configuration of the present invention, a pressure relief valve 16 is provided by a suitable way, for instance, screwed to a threaded hole of the cylinder-shaped partition wall 10.

Figure 3:
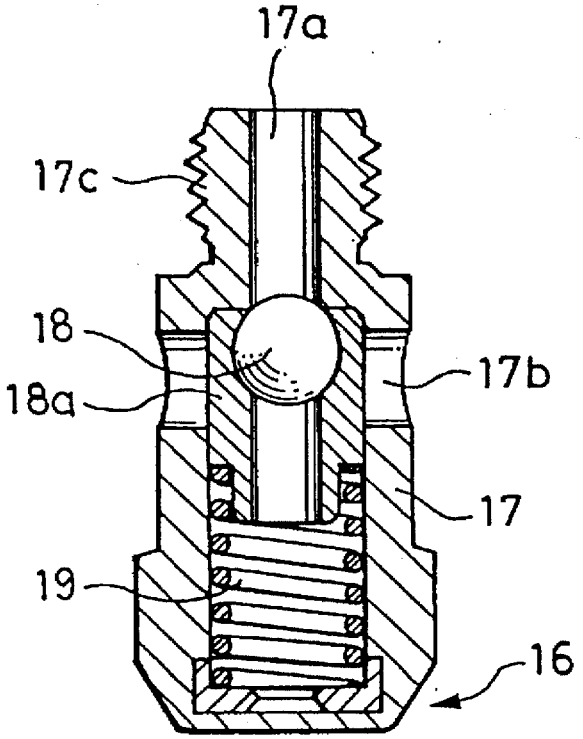
FIG. 3 is a cross-sectional view showing a pressure relief valve 16 provided in the cylinder-shaped partition wall 10 of FIG. 2.

A detailed configuration of the pressure relief valve 16 will be elucidated with reference to FIG. 3. FIG. 3 is a cross-sectional view showing a pressure relief valve 16 screwed to the cylinder-shaped partition wall 10 of FIG. 1.

As shown in FIG. 3, the pressure relief valve 16 comprises a cylindrical housing 17, a steel ball 18, which is inserted into the cylindrical housing 17 at an inlet 17a at one end part of the cylindrical housing 17 with a supporting member 18*a*, and a compression spring 19 which is inserted into the other end part of the cylindrical housing 17. A pair of an outlet 17*b* are formed in the intermediate part of the cylindrical housing 17. A fixing screw part 17*c* is formed at the one end part of the cylindrical housing 17. The supporting member 18*a* is held by the compression spring 19 in the cylindrical housing 17 so as to close the communication between the inlet 17*a* and the outlet 17*b*.

The pressure relief valve 16 is provided in the cylinder-shaped partition wall 10 so that the inlet 17*a* leads to the delivery chamber 7, and the outlet 17*b* leads to the suction chamber 8. When pressure value of the high-pressure coolant in the delivery chamber 7 exceeds a setting value of the pressure relief valve 16, the high-pressure coolant in the delivery chamber 7 presses down the steel ball 18 and the supporting member 18*a* against an elastic force of the compression spring 19. Thereby, the inlet 17*a* is communicated with the outlet 17*b*, and the high-pressure coolant in the delivery chamber 7 flows to the suction chamber 8 through the inlet 17*a* and the outlet 17*b*, and decreases the excessive pressure of the coolant.

Furthermore, as shown in FIGS. 1 and 2, a thermal switch 20 is mounted on the stator winding 5*d* at the position to receive heat of the high-pressure coolant (e.g., 120° C.) relieved from the pressure relief valve 16 into the suction chamber 8.

Figure 4:
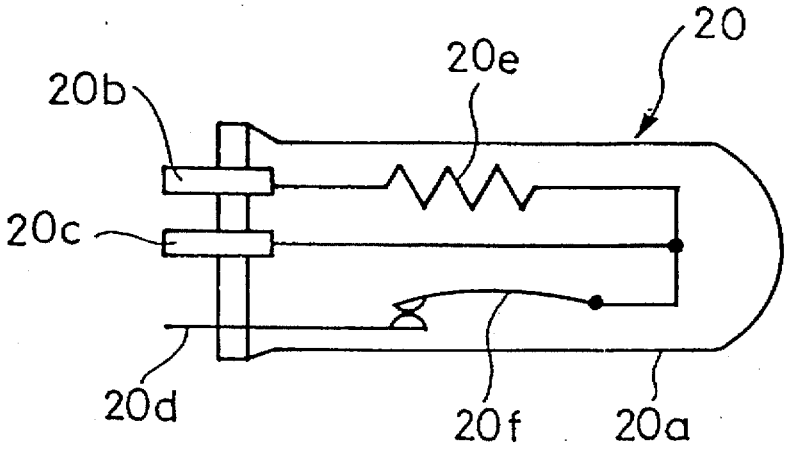
FIG. 4 is a circuit diagram showing a thermal switch 20 of the present invention.
Figure 5:
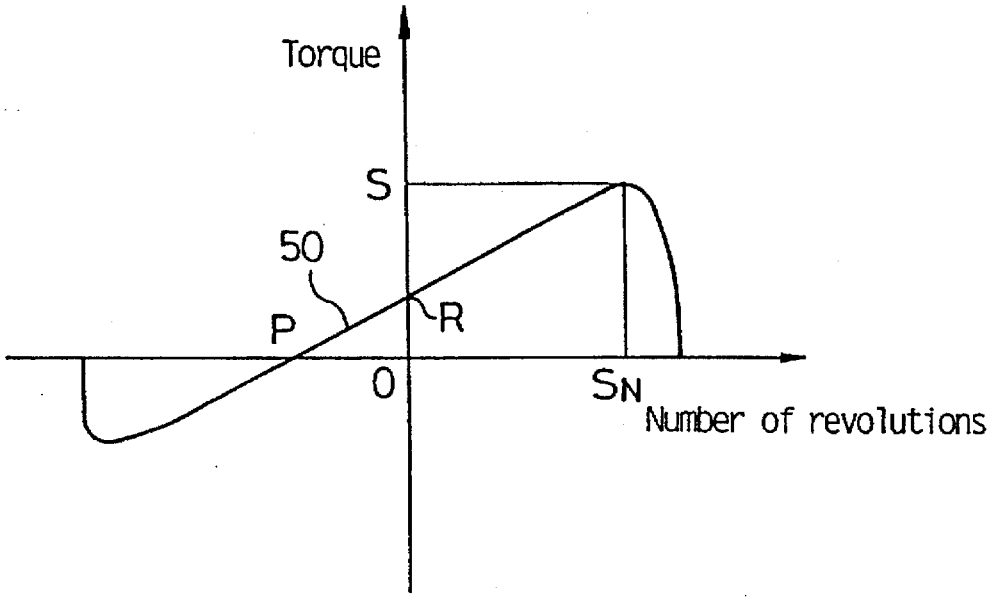
FIG. 5 shows a characteristic curve showing a torque curve 50 of an electric motor 5.
Figure 6:
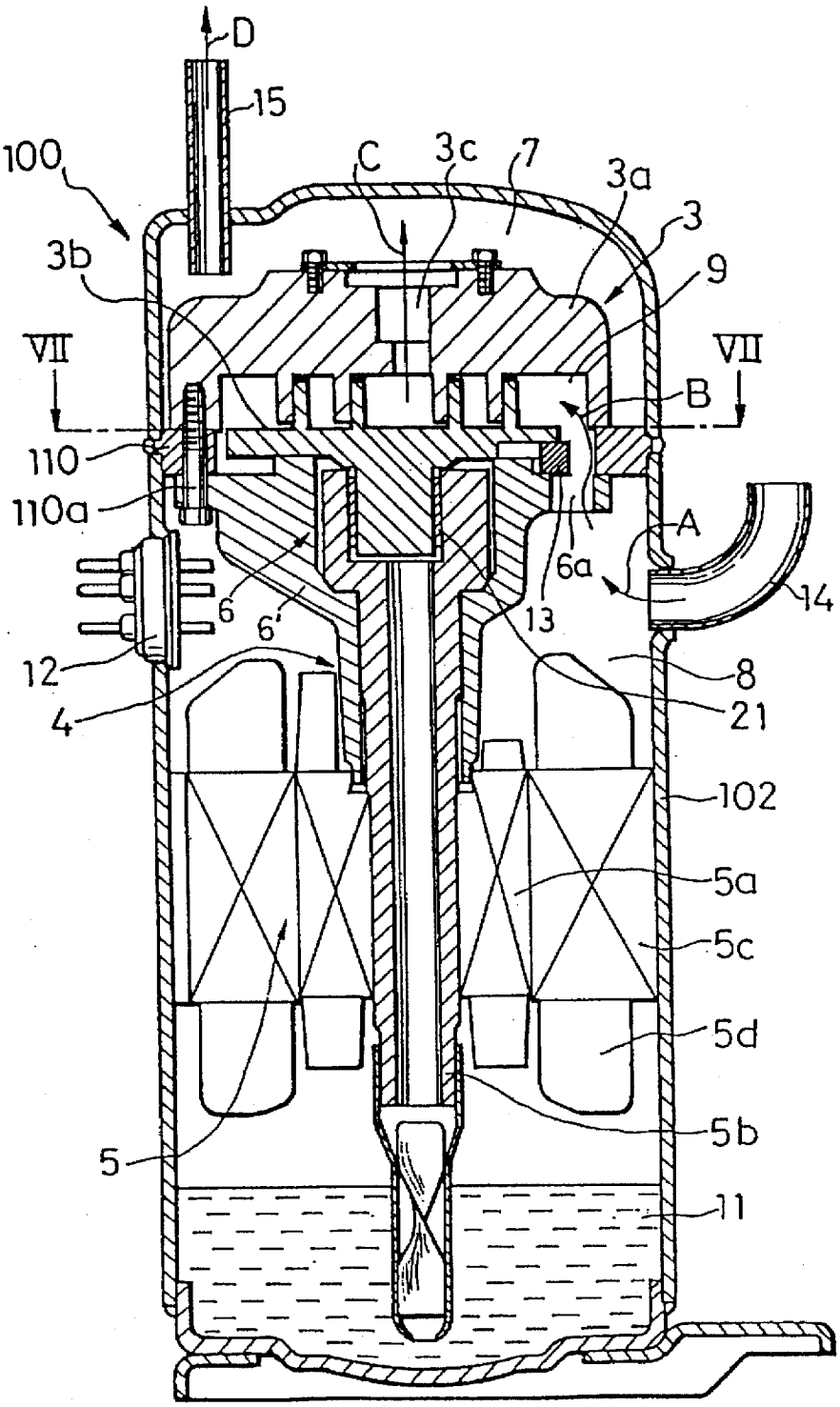
PRIOR ART FIG. 6
FIG. 6 is a cross-sectional view showing a conventional scroll compressor 100 disclosed in the Japanese unexamined and published patent application (TOKKAI) Sho 63-268993.
Figure 7:
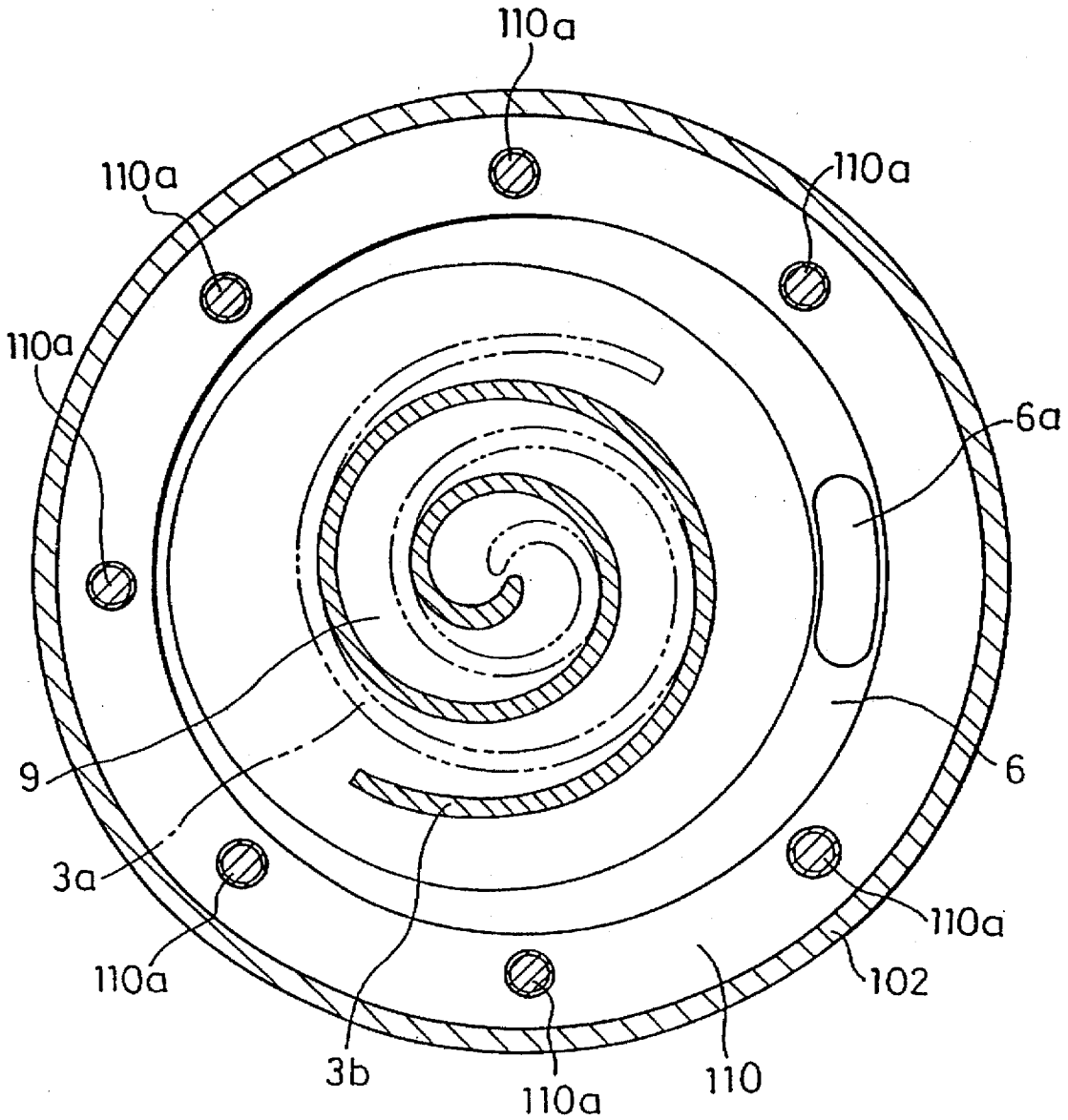
PRIOR ART FIG.7
FIG. 7 is a cross-sectional view, which is drawn by the inventor taken on line VII—VII of FIG. 6, showing a cylinder-shaped partition wall 110 of the scroll compressor 1 of FIG. 6.

A concrete configuration of the thermal switch 20 will be elucidated with reference to FIG. 4, which is a circuit diagram showing a thermal switch 20 of the present invention.

As shown in FIG. 4, a metallic case 20*a* of the thermal switch 20 has three terminals 20*b*, 20*c* and 20*d*, and contains a resistance element 20*e* and a thermal switch element 20*f* therein. The thermal switch 20 is connected between a power supply (not shown) and the stator winding 5*d* which consists of a main coil (not shown) and an auxiliary coil (not shown), for example, as follows:

(1) One ends of the main coil and the auxiliary coil are connected to terminal pins 12*a* and 12*b* of the terminal 12 (FIG. 1) by lead wires (not shown), respectively.

(2) The other ends of the main coil and the auxiliary coil are connected to the terminals 20*c* and 20*b* by lead wires (not shown), respectively.

(3) The terminal 20*d* is connected to terminal pin 12*c* of the terminal 12 (FIG. 1) by a lead wire (not shown).

Thus, the electric motor 5 is connected to the power supply via the thermal switch 20, and the electric motor 5 is stopped by an opening of the thermally actuated switch part 20*f* when a load current of the electric motor 5 exceeds a predetermined value so as to raise temperature of the thermal switch 20.

An operation of the scroll compressor 1 will be elucidated with reference to arrows A, B, C and D shown in FIG. 1. Arrows A, B, C and D designate flow of the coolant.

As shown by the arrow A, a low-pressure coolant is supplied to the suction chamber 8 from a known evaporator (not shown) via a suction pipe 14. The low-pressure coolant has the following two actions in the suction chamber 8:

(1) The low-pressure coolant exerts pressure on a surface of lubricant oil 11 stored in a bottom of the sealed container 2. Thereby, it is possible to feed the lubricant oil 11 with the bearing system 6 via a through hole of the crank shaft 5*b*.

(2) The low-pressure coolant additionally cools the driving motor 4 of the scroll compressor 1.

As shown by the arrow B, the low-pressure coolant is supplied to the compression chamber 9 via a suction hole 6*a* bored in the bearing system 6. In the compression chamber 9, the low-pressure coolant is compressed by the orbiting motion of the orbiting scroll member 3*b* against the stationary scroll member 3*a*, and compressed into a high-pressure coolant.

As shown by the arrow C, the high-pressure coolant is supplied to the delivery chamber 7 via a discharging hole 3*c* formed in the stationary scroll member 3*a*. The high-pressure coolant is temporarily stored in the delivery chamber 7 in order to prevent pulsating delivery of the high-pressure coolant from the delivery chamber 7 in the below-mentioned state shown by the arrow D.

As shown by the arrow D, the high-pressure coolant is supplied to a known condenser (not shown) via a discharging pipe 15. Furthermore, as is well known, a refrigerating cycle of the coolant is completed by connecting a known expansion device (not shown) between the condenser and the evaporator.

In the following, the operation of the scroll compressor 1 of the present invention is explained when a sudden and abnormal increase occurs in pressure of the high-pressure coolant of the delivery chamber 7 caused by a stoppage of a blower of the condenser:

Firstly, the pressure relief valve 16 is operated by the pressure of the high-pressure coolant of the delivery chamber 7. Thereby, it is possible to prevent excessive increase of the pressure of the high-pressure coolant of the delivery chamber 7.

Secondary, the high-pressure coolant flown from the outlet 17*b* heats the thermal switch 20. Therefore, the operation speed of the moving thermal switch part 20*f* is much increased. Therefore, the value of trip current of the electric motor 5 is reduced. In this time, value of the load current of the electric motor 5 is large value since the high-pressure coolant of the compression chamber 9 is high pressure condition. Therefore, the thermal switch 20 is immediately operated by an increase of the temperature caused by the high-pressure coolant flown from the outlet 17*b*. As a result, the electric motor 5 stops without an reversal rotation, and it is possible to prevent occurrences of damages in the compression part 3 and the driving motor 4.

The set value of operation of the pressure relief valve 16 is determined such that the pressure relief valve 16 operates before the load torque of the electric motor 5 exceeds a stalling torque of the electric motor 5. Therefore, the stoppage of the electric motor 5 is prevented before the operation of the pressure relief valve 16. Therefore, it is possible to prevent flowing of the high-pressure coolant of the compression chamber 9 from the compression chamber 9 to the suction chamber 8.

According to the theory of compression of the scroll compressor, the compressed volume is constant. Therefore, if the pressure relief valve 16 only would be provided in the scroll compressor 1 without the provision of the thermal switch 20, there would be a fear that the suction pressure in the compression chamber 9 would be raised thereby raising the internal pressure of the compression chamber 9, and the compression part 3 would be seriously damaged. That is, if the high-pressure coolant of the delivery chamber 7 would be simply released the suction chamber 8 by the operation of the pressure relief valve 16, the pressure of the coolant of the suction chamber 8 would rise undesirably, and thereby, the pressure of the coolant of the compression chamber 9 would be further increased, to damage the compression part 3.

According to the present invention, as a result of providing both the pressure relief valve 16 and the thermal switch 20 in the scroll compressor 1, it is possible to stop the electric motor 5 always before undesirable rise of the coolant pressure in the compression chamber 9. As a result of cooperation of the pressure relief valve 16 and the thermal switch 20. Therefore, undesirable damage on the compression part 3 of the scroll compressor 1 can be avoided.

Although the present invention has been described in terms of the presently preferred embodiments, it is to be understood that such disclosure is not to be interpreted as limiting. Various alterations and modifications will no doubt become apparent to those skilled in the art to which the present invention pertains, after having read the above disclosure. Accordingly, it is intended that the appended claims be interpreted as covering all alterations and modifications as fall within the true spirit and scope of the invention.

What is claimed is:

1. A scroll compressor comprising:

a sealed container;

a partition wall provided in said sealed container which partitions an internal space of said sealed container into a delivery chamber which contains compressed coolant and a suction chamber in which a motor is located;

a pressure relief valve for relieving said compressed coolant from said delivery chamber when pressure of said compressed coolant exceeds a predetermined pressure, said pressure relief valve being pressure actuated by said compressed coolant and being located in said partition wall, said pressure relief valve having an inlet and an outlet, said inlet leading to said delivery chamber, and said outlet being located in said suction chamber; and a thermal switch located in said suction chamber in an aligned position with the outlet such that compressed coolant being relieved from said pressure relief valve flows onto said thermal switch to control the operation of said motor.

2. The scroll compressor of claim 1 wherein the thermal switch is mounted on the motor.

3. The scroll compressor of claim 1 wherein the pressure relief valve outlet and the thermal switch are radially aligned.

4. The scroll compressor of claim 1 wherein the motor is a single-phase induction motor.

5. A scroll compressor comprising:

a sealed container;

a stationary scroll member and an orbiting scroll member engaged with the stationary scroll member located in the sealed container;

a partition wall provided in the sealed container beneath the orbiting scroll member to partition an internal space of the sealed container into a delivery chamber for containing compressed coolant and a suction chamber;

a motor located in said suction chamber drivingly connected to the orbiting scroll member, the motor having a stalling torque;

a pressure relief valve which releases the compressed coolant from the delivery chamber when a pressure of the compressed coolant exceeds a predetermined pressure, the pressure relief valve being pressure actuated by the compressed coolant and being located in the partition wall, the pressure relief valve having an inlet and an outlet, the inlet leading to the delivery chamber, and the outlet being located in the suction chamber, the predetermined pressure having a set value wherein the pressure relief valve opens prior to a load torque on the motor exceeding the stalling torque prior to reverse rotation of the orbiting scroll member with respect to the stationary scroll member; and a thermal switch located in an aligned position with the outlet such that compressed coolant from the outlet flows onto the thermal switch to control the operation of the motor.

* * * * *